US006821702B2

(12) United States Patent
Fujii et al.

(10) Patent No.: US 6,821,702 B2
(45) Date of Patent: Nov. 23, 2004

(54) METHOD OF FORMING IMAGES

(75) Inventors: Takahisa Fujii, Minamiashigara (JP); Yasuo Matsumura, Minamiashigara (JP); Hidekazu Yaguchi, Minamiashigara (JP); Satoshi Yoshida, Minamiashigara (JP); Tomohito Nakajima, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/342,265

(22) Filed: Jan. 15, 2003

(65) Prior Publication Data

US 2003/0175611 A1 Sep. 18, 2003

(30) Foreign Application Priority Data

Jan. 18, 2002 (JP) ..... 2002-010241

(51) Int. Cl.[7] ..... G03G 15/20
(52) U.S. Cl. ..... 430/124
(58) Field of Search ..... 430/124, 108.1, 430/110.1, 108.8

(56) References Cited

U.S. PATENT DOCUMENTS 4,526,459 A * 7/1985 Bresnick ..... 399/320
2002/0081510 A1 * 6/2002 Sugiyama et al. ..... 430/108.1
2003/0022084 A1 * 1/2003 Sugiyama et al. ..... 430/108.1

OTHER PUBLICATIONS

Diamond, Arthur S. (editor) Handbook of Imaging Materials. New York: Marcel–Dekker, Inc. (1991) pp. 160–163.*

* cited by examiner

*Primary Examiner*—Christopher Rodee
(74) *Attorney, Agent, or Firm*—Oliff & Berridge, PLC

(57) ABSTRACT

The present invention relates to a method of forming images. The method includes the steps of forming electrostatic latent images on an electrostatic image carrier, forming toner images with a toner-containing developer by developing the electrostatic latent images on the electrostatic image carrier, transferring the toner images onto a transfer material, and thermally fixing the toner images, wherein an electrophotographic toner including containing at least a binder resin, a colorant, and a releasing agent in the range of 10 to 25% by mass relative to toner particles and having a shape factor SF1 of 140 or less is used as the toner, and the thermal fixing step is carried out so as to satisfy, at a process speed of at least 170 mm/sec., the relationship (A): $200<0.7\times\alpha+2000\times\beta$ wherein $\alpha$ is a fixing temperature (° C.), $\beta$ is a heating time (second), and $\alpha$ is 160° C. or higher.

17 Claims, No Drawings

METHOD OF FORMING IMAGES

BACKGROUND OF THE INVENTION

1. Field of the Invention

The present invention relates to a method of forming images, such as an electrophotographic method or an electrostatic recording method used in devices utilizing an electrophotographic process, such as a copy machine, a printer, a facsimile or the like, particularly a color copy machine.

2. Description of the Related Art

Methods of visualizing image information via an electrostatic image, such as an electrophotographic method, are used in various fields. In the electrophotographic method, electrostatic images are formed on a photoreceptor in a charging and light-exposure step, the electrostatic latent images are then developed with a toner-containing developer to form visible images, and the visible images are transferred to a recording material and then fixed. The developer used herein includes a two-component developer containing a carrier and a toner and a one-component developer using a magnetic or non-magnetic toner alone. The toner is usually produced by a kneading and milling process in which a thermoplastic resin is melt-kneaded with a pigment, a charge control agent, and a releasing agent such as wax, and the resultant mixture is then cooled, pulverized, and classified. Fine inorganic or organic particles for improving fluidity and cleaning properties may be added to the surfaces of such toner particles, if necessary.

Copy machines using a color electrophotographic method, printers, or combinations thereof such as facsimiles have become prevalent in recent years, but if gloss suitable for reproduction of color images and transparency for achieving excellent images for an overhead projector (OHP) are to be realized, use of a releasing agent such as wax is generally difficult. Accordingly, a large amount of oil is applied onto fuser rolls to facilitate release of a toner from the fuser rolls. However, this causes reproduced images, such as OHP images, to become sticky and makes writing on the images with a pen difficult, and uneven gloss may often occur. Application of generally used polyethylene, polypropylene, and wax, such as paraffin, to ordinary black and white copies is more difficult because OHP transparency is deteriorated.

Even if transparency is sacrificed, a toner produced by the conventional kneading and milling process hardly prevents exposure of the wax to the toner surface, so that when the toner is used as a developer, problems arise, such as a significant deterioration in fluidity and filming on a developing machine and a photoreceptor.

As a method for essentially solving these problems, a polymerization process in which a toner is produced by dispersing an oil phase containing a monomer (starting material of a resin) and a colorant in an aqueous phase and then polymerizing the monomer directly, thereby allowing the wax to be included inside of the toner to control exposure of the wax to the surface, has been proposed.

A method of producing a toner by an emulsion polymerization flocculation method is proposed in Japanese Patent Application Laid-Open (JP-A) Nos. 63-282752and 6-250439 as another means of enabling intentional regulation of the shape and surface structure of a toner. These publications disclose production processes which include steps of preparing a dispersion of fine resin particles generally by emulsion polymerization while separately preparing a dispersion having colorant particles dispersed in a solvent, mixing the dispersions to form flocculated particles having a size corresponding to the particle diameter of an intended toner, and fusing the particles by heating to form the toner.

Such production processes cannot only realize inclusion of wax inside of a toner but also facilitate a smaller diameter of the toner to achieve reproduction of sharp images of higher resolution.

As color copy machines and printers have become faster in recent years, they have been expected to fulfill a role as printing machines for small numbers of copies. When they are used as printers, longer-term storage ability of documents and greater applicability to various kinds of paper than for office use are required, and even if highly glossy paper used in pamphlets is used, kinship of gloss of the paper and developed images is essential. Conventional machines intended for use in offices can give gloss to images by reducing a feeding speed of paper in a thick-paper mode, but such approach cannot be applied at present to machines expected to achieve high productivity.

SUMMARY OF THE INVENTION

Accordingly, the present invention is to solve the problems in the prior art described above, to achieve the following object. That is, the object of the invention is to provide a method of forming images which are highly glossy, are excellent in storage ability and have excellent transmission when formed on OHP sheets with high productivity.

The invention provides a method of forming images, the method comprising the steps of: forming electrostatic latent images on an electrostatic image carrier, forming toner images with a toner-containing developer by developing the electrostatic latent images on the electrostatic image carrier, transferring the toner images onto transfer materials, and thermally fixing the toner images, wherein an electrophotographic toner comprising at least a binder resin, a colorant, and a releasing agent in the range of 10 to 25% by mass relative to toner particles and having a shape factor SF1 of 140 or less is used as the toner, and the thermal fixing step is carried out so as to satisfy, at a process speed of at least 170 mm/sec., the relationship (A): $200<0.7\times\alpha+2000\times\beta$ wherein $\alpha$ is a fixing temperature (° C.), $\beta$ is a heating time (second), and $\alpha$ is 160° C. or higher.

DETAILED DESCRIPTION OF THE PREFERRED EMBODIMENTS

Hereinafter, the present invention is described in more detail.

The method of forming images according to the invention is characterized in that an electrophotographic toner comprising at least a binder resin, a colorant, and a releasing agent in the range of 10 to 25% by mass relative to toner particles and having a shape factor SF1 of 140 or less is used as the toner, and the thermal fixing step is carried out so as to satisfy, at a process speed of at least 170 mm/sec., the relationship (A): $200<0.7\times\alpha+2000\times\beta$ wherein $\alpha$ is a fixing temperature (° C.), $\beta$ is a heating time (second), and $\alpha$ is 160° C. or higher.

To achieve high gloss, the surface of fixed images should have excellent smoothness, and such smoothness can be easily obtained when the viscoelasticity of the toner is decreased by increasing the fixing temperature, and how the releasing agent is allowed to ooze out onto toner images (fixed images) to give smooth toner images is important at high process speed. Further, unless the releasing agent oozes out on the surface of toner images, the storageability and transmission of the toner images are adversely affected. As a result of intensive study in view of this aspect, the present inventors found that although the fixing temperature has an effect on oozing of the releasing agent onto the surface of the toner image, the heating time is more important. Accordingly, the method of forming images according to the invention can form images which permit a releasing agent to ooze out suitably onto the surface of toner images even at a high process speed, are highly glossy, are excellent in storage ability and have excellent transmission when formed on OHP sheets while maintaining high productivity, by using a toner containing a suitable amount of a releasing agent and by carrying out the fixing step so as to satisfy, at a process speed of at least 170 mm/sec., the relationship between the fixing temperature and the heating time (fixing time) when heat is applied to an unfixed image.

In the method of forming images according to the invention, the thermal fixing step (fixing step) is carried out so as to satisfy, at a process speed of at least 170 mm/sec., the relationship (A) $200<0.7\times\alpha+2000\times\beta$ wherein $\alpha$ is a fixing temperature (° C.), $\beta$ is a heating time (second), and $\alpha$ is 160° C. or higher. When fixation is carried out in two or more stages, the relationship (A') $220<0.7\times\alpha+2000\times\beta$ is preferably satisfied, and the right side value of the above-described formula $(0.7\times\alpha+2000\times\beta)$ in the first stage is preferably higher than that in the second stage. That is, it is desired that fundamental fixation is carried in the first stage, and fixation for making the surface uniform is carried out in the second and subsequent stages. When fixation is carried out in two or more stages, it is necessary that not the value $(0.7\times\alpha+2000\times\beta)$ in each stage but the total thereof exceeds 200. When the value $(0.7\alpha+2000\times\beta)$ for one stage fixation or the total thereof for multistage fixation is 200 or less, the releasing agent cannot sufficiently ooze out on the surface of toner images (fixed images), resulting in failure to achieve high gloss, and the releasing agent remaining in the fixed images not only deteriorates the strength of the fixed images but also scatters transmitted light, and, when the images are fixed on OHP sheets, causes cloudiness of the image and deteriorates transmission.

Further, when the fixing temperature is less than 160° C., the viscosity of the fused toner is high even if the fixing time is prolonged, which makes transfer of the releasing agent (wax) to the surface of the fixed images difficult. The upper limit of the fixing temperature is preferably 220° C. or less, and hot offset may occur at a temperature higher than 220° C. The fixing temperature is obtained by measuring the surface of a heating member with a thermocouple. Specifically, the fixing temperature is obtained as the average of at least 3 points (in the vicinity of both ends and in the middle of the heating member) in the direction of the major axis of the heating member (direction perpendicular to the conveyance direction of paper).

The heating time (sec.) expressed as $\beta$ is time determined from fixing member nip width (mm)/process speed (mm/sec.). Further, the fixing step may be carried out in one stage by using one fixation device or in two or more stages in a tandem system having two or more devices arranged in series. When the fixing step is carried in 2 or more stages, the right side of the relationship (A) above is expressed as $\{[0.7\times\alpha\mathbf{1}+2000\times\beta\mathbf{1}]+[0.7\times\alpha\mathbf{2}+2000\times\beta\mathbf{2}]+\ .\ .\ .\ +[0.7\times\alpha i+2000\times\beta i]\}$ wherein the fixing temperature and time in the first stage are $\alpha\mathbf{1}$ and $\beta\mathbf{1}$, respectively, and the fixing temperature and time in the second stage are $\alpha\mathbf{2}$ and $\beta\mathbf{2}$, respectively, and the fixing temperature and time in the $i^{th}$ stage are $\alpha i$ and $\beta i$, respectively. The formula described above was experimentally obtained.

Hereinafter, the toner used in the method of forming images according to the invention is described. The toner contains a releasing agent in the range of 10 to 25% by mass relative to toner particles, and the releasing agent is contained in an amount of preferably 15 to 25% by mass, and more preferably 17 to 20% by mass. If the amount of the releasing agent is less than 10% by mass, so-called document offset where a part of the fixed image is transferred to an opposite paper or image by heat or pressure may occur during long-term storage of a document obtained by fixation, and if the amount is higher than 25% by mass, the viscoelasticity of the toner fused during fixation is extremely lowered, which causes hot offset, or there arises a phenomenon called wax offset in which the releasing agent adheres to a fuser roll without penetrating into OHP sheets, which leaves a trace of the releasing agent on OHP sheets even after second rolling.

From the viewpoint of facilitating oozing of the releasing agent onto the surface of the toner image, the average domain diameter of the releasing agent in the toner is preferably 0.5 to 2.3 $\mu$m, and more preferably 0.8 to 1.6 $\mu$m. If this average domain diameter is less than 0.5 $\mu$m, the releasing agent may hardly ooze out even if the heating time is sufficient, while if the average domain diameter is higher than 2.3 $\mu$m, the releasing agent easily oozes out on the surface of the toner, and the exposed releasing agent has an external additive easily embedded therein, and may cause filming to a photosensitive material or pollution of a device.

The average domain diameter of the releasing agent is determined by observing cross-sections of at least 100 releasing agent particles with a transmission electron microscope TEM unit (for example, JEM-1010 type electron microscope, produced by JEOL. Ltd.), and obtaining the major axis diameters thereof as domain diameters and calculating the average of major axis diameters.

A method of regulating the average domain diameter of the releasing agent in the toner is preferably conducted in a cooling step in which fused flocculated particles are cooled and which is carried out after a fusion step in a wet process (flocculation fusion process) described later. The average domain diameter of the releasing agent in rapid cooling at about 5° C./min. is often near to the diameters of the releasing agent particles in a dispersion in the flocculation step, while the releasing agent particles tend to flocculate mutually in slow cooling at 1° C. or less/min. to grow as coarse domains. Accordingly, the average domain diameter of the releasing agent can be preferably regulated by suitably regulating the cooling rate.

The shape factor SF1 of the toner is 140 or less, preferably 137 or less, and more preferably 135 or less. When the shape factor SF1 is higher than 140, transferability may be lowered, and the density of a toner image may be lowered. When the shape factor SF1 is too low, mutual adhesion of toner particles is weakened, which easily causes undesirable scattering of the toner during transfer.

The shape factor SF1 is defined as follows: $SF1=(ML^2/A)\times(\pi/4)\times100$ (ML: absolute maximum lengths of toner particles; A; projected areas of toner particles). SF1 is expressed numerically by analysis of mainly a microscopic image or a scanning electron microscopic (SEM) image with an image analyzer, and can be calculated for example in the following manner. Optical microscopic images of toners scattered on a slide glass are incorporated via a video camera into a Loozex image analyzer, and the maximum lengths and the projected areas of 100 or more toner particles are determined and the shape factor of each particle is calculated according to the equation described above and the average thereof is obtained. That is, the shape factor SF1 in the invention is determined by analyzing images observed under an optical microscope with the Loozex image analyzer.

A method for regulating the shape factor SF1 in the range of 115 to 140 may be a method in which toner particles obtained by kneading and milling are made spherical in hot air, but production of toners by a wet process (flocculation fusion process) described later is preferable from the viewpoint of production stability.

For image qualities, the volume average particle diameter of the toner should be in the range of 3 to 8 $\mu$m. If the volume average particle diameter is more than 8 $\mu$m, high image qualities may be hardly obtained, while if the diameter is less than 3 $\mu$m, stable charging may be hardly obtained.

Hereinafter, the toner and a production on method thereof them are described in more detail.

From the viewpoint of easy preparation of toner which has a small diameter and which has a sharp distribution of particle sizes and which can form high-quality images, it is preferable to obtain the toner by a wet process comprising an flocculation step of forming flocculated particles in a dispersion having at least fine resin particles, colorant particles and releasing agent particles dispersed therein to prepare a dispersion of flocculated particles, and a fusing step of heating the dispersion of flocculated particles to fuse the flocculated particles. The wet process can also comprise other steps if necessary.

In particular, a cooling step of cooling the fused flocculated particles is preferably provided after the fusing step. The average domain diameter of the releasing agent can be preferably regulated by suitably regulating the cooling rate in the cooling step as described above.

Further, the step of adding a dispersion of fine particles to the dispersion of flocculated particles and mixing them to allow the fine particles to adhere to the flocculated particles and to form sticked particles (adhesion step) may also be provided between the flocculation step and fusion step. In the adhesion step, a dispersion of fine particles is added to and mixed with the dispersion of flocculated particles prepared in the flocculation step so as to permit the fine particles to adhere to the flocculated particles and so as to form sticked particles, and the fine particles added are particles newly added to the flocculated particles and are thus also referred to as "additional fine particles" in this specification. The additional fine particles may be one kind of fine resin particles, fine releasing agent particles, fine colorant particles, a combination thereof or the like. A method of adding and mixing the dispersion of fine particles is not particularly limited, and for example, the fine particles may be added continuously little by little or added stepwise. By adding and mixing the fine particles (additional fine particles), generation of fine particles is prevented, and the distribution of particle sizes of the resultant toner for development of electrostatic images can be made sharp, which contributes to high-quality images. Further execution of the adhesion step is advantageous in the following respects: a pseudo-shell structure can be formed to reduce exposure of the internal additives such as the colorant and the releasing agent to the surface of the toner, resulting in improvements in charging properties and longevity, and the distribution of particle sizes can be maintained or prevented from varying during fusion in the fusion step, while a surfactant or a stabilizer for improving stability during fusion such as base or acid is unnecessary or may be added in the minimum amount, thus reducing costs and improving qualities. In particular, since the releasing agent is used in the invention, the additional fine particles mainly comprising fine resin particles are preferably added in the adhesion step. By using the method, the shape of the toner can be easily regulated in the fusion step by regulation of the temperature, the number of agitation, and pH.

Examples of the resin (binder resin) used in the fine resin particles and in the additional fine particles include thermoplastic resins which are specifically homopolymers and copolymers (styrene resins) of styrenes such as styrene, p-chlorostyrene and $\alpha$-methylstyrene; homopolymers and copolymers (vinyl resin) of esters having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate; homopolymers and copolymers (vinyl resin) of vinylnitriles such as acrylonitrile and methacrylonitile; homopolymers and copolymers (vinyl resin) of vinyl ethers such as vinyl ethyl ether and vinyl isobutyl ether; homopolymers and copolymers (vinyl resin) of vinyl methyl ketone, vinyl ethyl ketone, and/or vinyl isopropenyl ketone; homopolymers and copolymers (olefin resin) of olefins such as ethylene, propylene, butadiene and isoprene; and non-vinyl condensed resins such as epoxy resin, polyester resin, polyurethane resin, polyamide resin, cellulose resin and polyether resin, and graft polymers of these non-vinyl condensed resins with a vinyl monomer. These resins may be used alone or as a mixture of two or more thereof.

Among these resins, the vinyl resin is particularly preferable. The vinyl resin is advantageous because a dispersion of fine resin particles thereof can be easily prepared by emulsion polymerization or seed polymerization using an ionic surfactant and the like.

Examples of the vinyl monomers include monomers serving as starting materials of vinyl polymer acids or vinyl polymer bases such as acrylic acid, methacrylic acid, maleic acid, cinnamic acid, fumaric acid, vinylsulfonic acid, ethylene imine, vinylpyridine and vinylamine. In the invention, the vinyl monomer is preferably contained in a monomer or monomers of the fine resin particles. Among these vinyl monomers, the vinyl polymer acids are preferable for easier reaction to form vinyl resins, and specifically, dissociable vinyl monomers having a carboxyl group as a dissociable group, such as acrylic acid, methacrylic acid, maleic acid, cinnamic acid and fumaric acid, are particularly preferable for regulation of the degree of polymerization and glass transition point.

The average particle diameter of the fine resin particles in the dispersion is preferably 1 $\mu$m or less, and more preferably in the range of 0.01 to 1 $\mu$m. When the average particle diameter is higher than 1 $\mu$m, a distribution of particle sizes of the resulting toner particles produced by floculation and fusion is broadened, while free particles are easily generated and causes a reduction in the performance and reliability of the toner. By regulating the average particle diameter of the fine resin particles particularly in the range described above, there is an advantage that the dispersion of the fine resin particles in the flocculated particles can be improved thus preventing an uneven composition among the toner particles and reducing inconsistency of toner performance and reliability to a low level.

The average diameter of the fine resin particles can be measured by a laser diffraction type particle size distribution measuring instrument and a Coulter counter.

Examples of the colorant (particles) include pigments such as carbon black, chrome yellow, Hansa yellow, benzidine yellow, threne yellow, quinoline yellow, permanent orange GTR, pyrazolone orange, vulcan orange, watch young red, permanent red, brilliant carmine 3B, brilliant carmine 6B, Dupont oil red, pyrazolone red, lithol red, rhodamine B lake, lake red C, rose Bengal, aniline blue, ultramarine blue, chalco oil blue, methylene blue chloride, phthalocyanine blue, phthalocyanine green, malachite green oxalate, as well as dyes of acridines, xanthenes, azos, benzoquinones, azines, anthraquinones, dioxazines, thiazines, azomethines, indigos, thioindigos, phthalocyanines, aniline blacks, polymethines, triphenylmethanes, diphenylmethanes, thiazoles and xanthenes. These colorants may be used alone or as a mixture of two or more thereof.

The average particle diameter of the colorant (particles) in the dispersion is preferably 1 μm or less, more preferably 0.5 μm, and still more preferably in the range of 0.01 to 0.5 μm. When the average particle diameter is higher than 1 μm, the particle size distribution of the finally obtained toner for electrostatic charge development is broadened, while free particles are easily generated and causes a reduction in the performance and reliability of the toner. By regulating the average particle diameter of the colorant particles particularly in the range described above, there is an advantage that the dispersion of the colorant in the flocculated particles can be improved thus preventing an uneven composition among the toner particles and reducing inconsistency of toner performance and reliability to a low level. When the average particle diameter of the colorant particles is 0.5 μm or less, the toner coloration, color reproduction, and OHP transmission can be further improved. The content of the colorant (particles) in the flocculated particles is preferably 50% by mass or less, and more preferably in the range of 2 to 20% by mass.

The average diameter of the colorant particles can be measured by a laser diffraction type particle size distribution measuring instrument.

Preferably, the releasing agent (particles) is generally poor in compatibility with the binder resin (fine resin particles). When a releasing agent highly compatible with the binder resin (fine resin particles) is used, the releasing agent may be fused with the binder resin to promote plasticization of the binder resin, and the viscosity of the toner during high-temperature fusion may be lowered, which causes offset easily.

Examples of the releasing agent (particles) include; low-molecular polyolefins such as polyethylene, polypropylene and polybutene; silicones having a softening point when heated; fatty amides such as oleic amide, erucic amide, ricinoleic amide and stearic amide; vegetable wax such as carnauba wax, rice wax, candelilla wax, Japan wax and jojoba oil; animal wax such as beeswax; mineral and petroleum wax such as montan wax, ozokerite, seresin, paraffin wax, microcrystalline wax, Fischer-Tropsch wax, ester waxes of a higher fatty acid and a higher alcohol, such as stearyl stearate, and behenyl behenate; ester waxes of a higher fatty acid and a monovalent or polyvalent lower alcohol, such as butyl stearate, propyl oleate, glyceride monostearate, glyceride distearate and pentaerythritol tetrabehenate; ester waxes made from a higher fatty acid and a polyvalent alcohol polymer, such as diethylene glycol monostearate, dipropylene glycol distearate, diglyceride distearate and triglyceride tetrastearate; ester waxes of sorbitan and a higher fatty acid such as sorbitan monostearate; ester waxes of cholesterol and a higher fatty acid such as cholesteryl stearate. These releasing agents may be used alone or as a mixture of two or more thereof.

The average particle diameter of the releasing agent (particles) in the dispersion is preferably 2 μm or less, and more preferably in the range of 0.1 to 1.5 μm. When the average particle diameter is higher than 2 μm, the particle size distribution of the finally obtained toner for electrostatic charge development is broadened, while free particles are easily generated and causes a reduction in the performance and reliability of the toner. By regulating the average particle diameter of the releasing agent particles particularly in the range described above, there is an advantage that an uneven composition among the toner particles can be prevented, and inconsistency of toner performance and reliability can be reduced to a low level.

The average diameter of the releasing agent particles can be measured by a laser diffraction type particle size distribution measuring instrument or a centrifugation type particle size distribution measuring instrument.

In the flocculation step described above, fine particles of an internal additive, a charge control agent, fine inorganic particles, fine organic particles, a lubricant and an abrasive can be added to the dispersion of fine resin particles, the dispersion of colorant particles and the dispersion of releasing agent particles, if necessary. The fine particles may be added directly to and dispersed in the dispersion of fine resin particles, the dispersion of colorant particles or the dispersion of releasing agent particles, or a dispersion of the fine particles may be added to and mixed with a mixture of the dispersion of fine resin particles, the dispersion of colorant particles and the dispersion of releasing agent particles.

Examples of the internal additive include magnetic materials including metals such as ferrite, magnetite, reduced iron, cobalt, manganese and nickel, alloys thereof, and compounds containing any of these metals.

Examples of the charge control agent include dyes made of quaternary ammonium salt compounds, Nigrosine compounds, and complexes of aluminum, iron or chrome, and triphenyl methane pigment. The charge control agent is added for the purpose of regulation of ionic strength affecting stability at the time of flocculation, adhesion or fusion and for the purpose of reducing drainage pollution. The charge control agent is preferably material which hardly is solved in water.

Examples of the fine inorganic particles include the same additives as external additives to be bonded usually to the surface of the toner, such as silica, titania, calcium carbonate, magnesium carbonate, tricalcium phosphate and cerium oxide. Examples of the fine organic particles include the same additives as external additives to be bonded usually to the surface of the toner, such as vinyl resin, polyester resin, and silicone resin. These fine inorganic or organic particles can also be used as fluidizing assistants and cleaning assistants.

Examples of the lubricant include fatty amides such as ethylene bisstearic amide and oleic amide, and metal salts of fatty acids, such as zinc stearate and calcium stearate. Examples of the abrasive includes silica, alumina, and cerium oxide.

The average particle diameter of the internal additive, charge control agent, fine inorganic particles, fine organic particles, lubricant, and abrasive is preferably 1 μm or less, and more preferably in the range of 0.01 to 1 μm. When the average particle diameter is higher than 1 μm, the particle size distribution of the finally obtained toner for electrostatic charge development is broadened, while free particles are easily generated and causes a reduction in the performance and reliability of the toner. By regulating the average particle diameter of these particles particularly in the range described above, there is an advantage that an uneven composition among the toner particles can be prevented, and inconsistency of toner performance and reliability can be reduced to a low level. Fine particles other than those described above can be added if necessary in such a range that the effect of the invention is not inhibited, and their amount is generally very small, specifically in the range of about 0.01 to 5% by mass, and preferably 0.01 to 3% by mass.

The average diameter of these particles can be measured by a laser diffraction type particle size distribution measuring instrument or a centrifugation type particle size distribution measuring instrument.

A dispersion using the materials described above and prepared by mixing at least the dispersion of fine resin particles, the dispersion of colorant particles and the dispersion of releasing agent particles and, if necessary, other components is heated while stirred in the temperature range of from room temperature to a temperature higher than the glass transition temperature of the resin by about 5° C., whereby the fine resin particles and the colorant are flocculated to form flocculated particles. The average particle diameter of the flocculated particles is preferably in the range of 2 to 9 μm. The flocculated particles thus formed may be coated with a coating layer by adding the fine resin particle (additional fine particles) thereto (adhesion stage). Then, the flocculated particles are fused by heat treatment at a temperature not less than the softening point of the resin, generally in the range of 70 to 120° C., to give a solution containing toner particles (dispersion of toner particles). If necessary, the solution containing toner particles (dispersion of toner particles) is cooled in the subsequent cooling stage. Then, the resultant solution containing toner particles is centrifuged or filtered under suction, whereby the toner particles are separated, followed by washing once to thrice with deionized water. By regulating the pH during this washing, the washing effect can be further improved. Thereafter, the toner particles are separated by filtration, washed once to thrice with deionized water and dried to give the toner.

Inorganic and organic powders can be added to the toner as fluidizing assistants, cleaning assistants, or abrasives. Examples of the inorganic powders include particles of any external additives usually used on the surface of the toner, such as silica, alumina, titania, calcium carbonate, magnesium carbonate, tricalcium phosphate and cerium oxide, and examples of the organic powders include particles of any external additives used usually on the surface of the toner, such as vinyl resin, polyester resin, silicone resin, and fluorine resin. Further, a lubricant may also be added. Examples thereof include fatty amides such as ethylene bisstearic amide, and oleic amide, and metal salts of fatty acids, such as zinc stearate, and calcium stearate. Among the inorganic powders, hydrophobic silica is preferably added as an essential component.

The composition of the toner can be selected depending on the object. The toner may be used alone as a one-component developer or used with a carrier as a two-component developer, and in the invention, a two-component developer suitable for high speed is preferably used for the purpose of high process speed.

The carrier is not particularly limited, and a carrier known per se can be used, and in particular a carrier coated with a resin is preferably used. Iron powder, and particles of ferrite and magnetite can be used as the core particles of the carriers, and the volume average particle diameter of the core is preferably in the range of 30 to 200 μm. Examples of the coating resin for the core particles include homopolymers and copolymers of two or mono monomers such as styrenes such as styrene, p-chlorostyrene and α-methyl styrene, α-methylene fatty monocarboxylates such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate, nitrogen-containing acryl derivatives such as dimethylaminoethyl methacrylate, vinylnitriles such as acrylonitrile and methacrylonitrile, vinylpyridines such as 2-vinylpyridine and 4-vinylpyridine, vinyl ethers such as vinyl methyl ether and vinyl isobutyl ether, vinyl ketones such as vinyl methyl ketone, vinyl ethyl ketone and vinyl isopropenyl ketone, olefins such as ethylene and propylene, and fluorine-containing vinyl monomers such as vinylidene fluoride, tetrafluoroethylene and hexafluoroethylene, as well as silicones such as methylsilicone and methylphenylsilicone, polyesters containing bisphenol and glycol epoxy resin, polyurethane resin, polyamide resin, cellulose resin, polyether resin, and polycarbonate resin. These resins may be used alone or as a mixture of two or more thereof. The amount of the coating resin is in the range of 0.1 to 10 parts by mass, and preferably 0.5 to 3.0 parts by mass, relative to 100 parts by mass of the core particles.

For production of the carrier, a heating kneader, heating Henschel mixer, mass UM mixer can be used. Depending on the amount of the coating resin, a heated fluidized bed, and a heated kiln can be used. The mixing ratio of the toner to the carrier is not particularly limited, and can be suitably determined depending on the object.

Hereinafter, the method of forming images according to the invention is described in more detail.

The method of forming images according to the invention is a method of forming images which comprises the steps of forming electrostatic latent images on an electrostatic image carrier, forming toner images with a developer containing a toner by developing the electrostatic latent images on the electrostatic image carrier, transferring the toner images onto transfer materials, and thermally fixing the toner images. The respective steps excluding the fixing step are general steps, which are described in e.g. JP-A Nos. 56-40868 and 49-91231, and applicable preferably in this specification. The method of forming images according to the invention can be plasticized by using an image forming device known per se, such as a copying machine and a facsimile. In the step of transferring toner images to transfer materials, the toner images on the electrostatic image carrier can be transferred directly to the transfer materials or via intermediate transfer materials to the transfer materials.

The fixing step is not particularly limited insofar as the relationship between the fixing temperature and the heating time described above can be satisfied. The fixing unit used in the fixing step may also be a fixing unit known in the art, but its heating member preferably has a release layer. The release layer is made preferably of a material excellent in releasability from the toner, for example silicone rubber, or fluororesin for the purpose of preventing the toner from adhering thereto. Examples of the fluororesin include a copolymer of tetrafluoroethylene and perfluoroalkyl vinyl ether, a copolymer of tetrafluoroethylene and ethylene, and a copolymer of tetrafluoroethylene and hexafluoroethylene. The thickness of the release layer can be selected depending on the object, but is preferably 10 to 60 μm.

Because the toner contains a releasing agent, the fixing unit used in the fixing step does not require a releasing liquid such as silicone oil to be applied onto the heating member, but the releasing agent may be applied in an amount of 1 $\mu$l or less per A4 paper for the purpose of securing a region for fixation at high temperatures.

When the fixing unit used in the fixing step is composed of two rolls, it is preferable to make the hardness of an elastic layer on the two rolls different from each other in order to allow the softer one to dent remarkably at a nip from the viewpoint of securing a heating time. Further, a fixing device composed of one roll and a belt out of which fixing device the roll is contacted with an unfixed toner image is more desirable for securing nip width relatively freely against pressure at a nip than the 2-rolls fixing unit. Further, the fixing unit has a low heat capacity of the belt and is thus preferable from the viewpoint of energy consumption. The material of the belt is preferably a heat-resistant material such as tetrafluoroethylene, and polyimide, and the thickness of the belt layer is preferably 2 mm or less, and the surface thereof preferably is coated with the same fluororesin as in the heating member. It is preferable that the heating roll is pressed by a press roll from the inside of the belt to form a concave in the heating roll, whereby nip width can be secured, and a paper just after passage through the fixing roll is discharged in such a direction as to separate from the roll contacting with the toner image, thus preventing the paper from adhering thereto.

EXAMPLES

Hereinafter, the present invention is described in more detail by reference to the Examples. However, these examples are not intended to limit the invention. The term "part" refers to "parts by mass".

The volume average particle diameter D50 of a toner was measured by a Coulter counter (TA2 type, Coulter Co., Ltd.). The average particle diameter of the fine resin particles, fine colorant particles and fine releasing agent particles was measured by a laser diffraction type particle size distribution measuring instrument (LA-700, Horiba, Ltd.). The molecular weight and molecular weight distribution of the resin in the flocculated particles and the resin for resin-coating (additional fine particles) were measured by gel permeation chromatography (HLC-8120GPC, Tosoh Corporation). The glass transition point of the resin particles was measured under the condition of an increasing temperature of 3° C./min. with a differential scanning calorimeter (DSC-50, Shimadzu Corporation). As the gloss, 75° gloss was measured by a gloss meter (MODEL GM-26D for 75°, Murakami Shikisai Kenkyusho Co., Ltd.). The light transmission of OHP was measured by fixating images on OHP sheets (XEROX FILM) produced by Fuji Xerox Co., Ltd. and then measuring the PE value with Match Scan II manufactured by DIANO Co., Ltd.

Preparation of Fine Resin Particle Dispersion (1)

| | |
|---|---|
| styrene | 350 parts |
| butyl acrylate | 50 parts |
| acrylic acid | 8 parts |
| dodecylmercaptan | 10 parts |
| carbon tetrabromide | 3 parts |

The components described above were previously mixed and dissolved to prepare a solution, and a surfactant solution prepared by dissolving 7 g of a nonionic surfactant (Noboneal, Sanyo Chemical Industries, Ltd.) and 10 g of a anionic surfactant (Neogen R, Dai-ichi Kogyo Seiyaku Co., Ltd.) in 520 g of deionized water and the above-described solution were introduced into a flask, dispersed, and emulsified, and a solution containing 70 g of deionized water and 3 g of ammonium persulfate was introduced into the flask while the content in the flask was mixed slowly for 10 minutes, and then flask was purged with nitrogen. Thereafter, the mixture in the flask was heated to 70° C. in an oil bath while stirred, and the emulsion polymerization was continued for 6 hours. Thereafter, this reaction solution was cooled to room temperature and a fine resin particle dispersion (1) having an average particle diameter of 148 nm, a glass transition point of 58.2° C. and a weight average molecular weight of 21,000 was thus obtained.

Preparation of Fine Resin Particle Dispersion (2)

| | |
|---|---|
| styrene | 280 parts |
| n-butyl acrylate | 100 parts |
| acrylic acid | 8 parts |
| dodecanthiol | 10 parts |
| carbon tetrabromide | 3 parts |

The components described above were previously mixed and dissolved to prepare a solution, and a surfactant solution prepared by dissolving 10 g of a nonionic surfactant (Noboneal, Sanyo Chemical Industries, Ltd.) and 6 g of an anionic surfactant (Neogen RK, Dai-ichi Kogyo Seiyaku Co., Ltd.) in 520 g of deionized water, and the above-described solution were introduced into a flask, dispersed, and emulsified, and a solution containing 70 g of deionized water and 3 g of ammonium persulfate was introduced into the flask while the content in the flask was mixed slowly for 10 minutes, and then flask was purged with nitrogen. Thereafter, the mixture in the flask was heated to 70° C. in an oil bath while stirred, and the emulsion polymerization was continued for 6 hours. Thereafter, this reaction solution was cooled to room temperature and a fine resin particle dispersion (2) having an average particle diameter of 160 nm, a glass transition point of 59.6° C. and a weight-average molecular weight of 23000 was thus obtained.

Preparation of Fine Resin Particle Dispersion (3)

| | |
|---|---|
| polyester | 220 parts |
| tetrahydrofuran | 300 parts |
| polyethylene glycol | 20 parts |
| deionized water | 500 parts |

The components described above were previously mixed, dissolved and dispersed for 15 minutes with a rotor stator homogenizer (Ultratarax, produced by IKA Co., Ltd.), and then the resultant dispersion was heated to and maintained at 80° C. for 4 hours and then cooled and a fine resin particle dispersion (3) having an average particle diameter of 200 nm, a glass transition point of 57.3° C. and a weight-average molecular weight of 20000 was thus obtained.

Dispersion of Colorant Particle Dispersion (1)

| | |
|---|---|
| phthalocyanine pigment (PVFASTBLUE, Dainichieseika Color & Chemicals Mfg. Co., Ltd.) | 70 parts |
| anionic surfactant (Wako Pure Chemical Industries, Ltd.) | 3 parts |
| deionized water | 400 parts |

The components described above were mixed, dissolved, and dispersed with a homogenizer (Ultratarax, produced by IKA Co., Ltd.) to give a colorant particle dispersion (1)

comprising the fine colorant particles (phthalocyanine pigment) having an average particle diameter of 150 nm.

Dispersion of Releasing Agent Particle Dispersion (1)

| | |
|---|---|
| polyethylene wax | 100 parts |
| (Polywax 655 with a melting point 93° C., Toyo-Petrolite) | 2 parts |
| anionic surfactant (Pionion A-45-D, Takemoto Oil & Fat Co., Ltd.) | |
| deionized water | 500 parts |

The components described above were mixed, dissolved, dispersed with a homogenizer (Ultratarax, produced by IKA Co., Ltd.), and further dispersed with a pressure discharge type homogenizer to give a releasing agent particle dispersion (1) comprising the fine releasing agent particles (polyethylene wax) having an average particle diameter of 280 nm.

Example 1

| Preparation of toner A | |
|---|---|
| fine resin particle dispersion (1) | 300 parts |
| colorant particle dispersion (1) | 200 parts |
| releasing agent particle dispersion (1) (18.0% by mass relative to the toner) | 110 parts |
| cationic surfactant (Sanizol B50, Kao Corporation) | 3 parts |
| deionized water | 500 parts |

The above components were mixed and dispersed with a homogenizer (Ultratarax T50, produced by IKA Co., Ltd.) in a stainless steel flask having a round bottom, and then heated in an oil bath to 50° C. while stirred and then kept at 50° C. for 30 minutes to form flocculated particles. When a part of the resulting flocculated particles were observed under an optical microscope, the average diameter of the flocculated particles was about 5.1 μm. 30 parts of the fine resin particle dispersion (1) was added gently to this flocculated particle dispersion and the resultant mixture was heated at 50° C. for 30 minutes, and the resulting flocculated particle dispersion was observed under an optical microscope and the average diameter of the flocculated particles was about 5.7 μm.

Then, 6 parts of an anionic surfactant, sodium dodecylbenzenesulfonate (Neogen SC, produced by Daiichi Industries, Ltd.), was further added to the dispersion, and the mixture was heated to 97° C., kept at 97° C. for 7 hours to fuse the flocculated particles. Thereafter, the mixture was cooled to 45° C. at a decreasing temperature of 0.5° C./min., filtered, sufficiently washed with deionized water, and filtered through a 400-mesh screen. The volume average particle diameter of the fused particles, as determined with a Coulter counter, was 5.8 μm. These were dried in a vacuum dehydrator and toner particles were obtained. Sections of the toner particles were confirmed with a TEM unit, and the average domain diameter of the releasing agent was 1.4 μm.

1.5 parts of colloidal silica (R972, produced by Nippon Aerosil Co., Ltd.) were added to 100 parts of the resulting toner particles and mixed by a Henschel mixer to give toner A.

Preparation of Developer A

Toner A was weighed on a glass vessel so that the concentration of the toner relative to ferrite carriers having a volume average diameter of 50 μm and coated with 1% of polymethyl methacrylate (Soken Chemical & Engineering Co., Ltd.) was 5% by mass and was mixed with the ferrite carriers on a ball mill for 5 minutes, and whereby developer A was obtained.

Formation of an Image

The resultant developer A was set in a VIVACE 400 modified machine (fixing unit was composed of a heating roll and a belt; nip width was 7 mm), and a toner density per unit area was adjusted to 4.0 mg/cm$^2$ and a toner image was formed on paper (gloss 47), and then fixed at a fixing temperature of 180° C. at a process speed of 180 mm/sec., and the difference in gloss between the fixed image and the paper was confirmed. The gloss was judged in terms of the difference from paper gloss (47) and "○" was given when the difference from the paper gloss was −5 or more, while "X" was given when the difference was less than −5. The resultant fixed images on 2 sheets of paper were allowed to be opposite to each other, loaded with a loading of 250 g/cm$^2$ and stored at 60° C. for 1 week in this state, and "○" was given when the opposite images did not adhere to each other, while "improper" was given when the opposite images adhered. Further, OHP transmission was evaluated by producing a toner image in a similar manner on an OHP sheet (XEROX FILM) produced by Fuji Xerox Co., Ltd. and then measuring the PE value. "○" was given when the PE value was 70% or more, and "X" was given when the PE value was less than 70%. The results are shown in Table 1.

Example 2

| Preparation of toner B | |
|---|---|
| fine resin particle dispersion (2) | 300 parts |
| colorant particle dispersion (1) | 200 parts |
| releasing agent particle dispersion (1) (21.9% by mass relative to the toner) | 140 parts |
| cationic surfactant (Sanizol B50, Kao Corporation) | 3 parts |
| deionized water | 500 parts |

The above components were mixed and dispersed with a homogenizer (Ultratarax T50, produced by IKA Co., Ltd.) in a stainless steel flask having a round bottom, and then heated in an oil bath to 50° C. while stirred and then kept at 50° C. for 30 minutes to form flocculated particles. When a part of the resulting flocculated particles were observed under an optical microscope, the average diameter of the flocculated particles was about 4.9 μm. 30 parts of the fine resin particle dispersion (2) was added gently to this flocculated particle dispersion and the resultant mixture was heated at 50° C. for 30 minutes, and the resulting flocculated particle dispersion was observed under an optical microscope and the average diameter of the flocculated particles was about 5.6 μm.

Then, 6 parts of an anionic surfactant, sodium dodecylbenzenesulfonate (Neogen SC, produced by Daiichi Industries, Ltd.), was further added to the dispersion, and the mixture was heated to 97° C., kept at 97° C. for 7 hours to fuse the flocculated particles. Thereafter, the mixture was cooled to 45° C. at a decreasing temperature of 0.7° C./min., filtered, sufficiently washed with deionized water, and filtered through a 400-mesh screen. The volume average particle diameter of the fused particles, as determined with a Coulter counter, was 5.6 μm. These were dried in a vacuum dehydrator and toner particles were obtained. Sections of the toner particles were confirmed with a TEM unit, and the average domain diameter of the releasing agent was 1.8 μm.

1.5 parts of colloidal silica (R972, produced by Nippon Aerosil Co., Ltd.) were added to 100 parts of the resulting toner particles and mixed by a Henschel mixer to give toner B.

Preparation of Developer B

Toner B was weighed on a glass vessel so that the concentration of the toner relative to ferrite carriers having a volume average diameter of 50 μm and coated with 1% of polymethyl methacrylate (Soken Chemical & Engineering Co., Ltd.) was 5% by mass and was mixed with the ferrite carriers on a ball mill for 5 minutes, and whereby developer B was obtained.

Formation of an Image

The resultant developer B was set in a VIVACE 400 modified machine (fixing unit was composed of 2 rolls; nip width was 5.5 mm; two fixing units are arranged in series), and a toner density per unit area was adjusted to 4.0 mg/cm$^2$ and a toner image was formed on paper (gloss 47), and then fixed in two stages at a fixing temperature of 180° C. at a process speed of 200 mm/sec., and the difference in gloss between the fixed image and the paper was confirmed. Further, storage under stress and evaluation of OHP transmission were carried out in the same manner as in Example 1. The results are shown in Table 1.

Example 3

| Preparation of toner C | |
|---|---|
| fine resin particle dispersion (3) | 300 parts |
| colorant particle dispersion (1) | 200 parts |
| releasing agent particle dispersion (1) (19.4% by mass relative to the toner) | 120 parts |
| cationic surfactant (Sanizol B50, Kao Corporation) | 3 parts |
| deionized water | 500 parts |

The above components were mixed and dispersed with a homogenizer (Ultratarax T50, produced by IKA Co., Ltd.) in a stainless steel flask having a round bottom, and then heated in an oil bath to 50° C. while stirred and then kept at 50° C. for 30 minutes to form flocculated particles. When a part of the resulting flocculated particles were observed under an optical microscope, the average diameter of the flocculated particles was about 4.7 μm. 30 parts of the fine resin particle dispersion (3) was added gently to this flocculated particle dispersion and the resultant mixture was heated at 52° C. for 45 minutes, and the resulting flocculated particle dispersion was observed under an optical microscope and the average diameter of the flocculated particles was about 5.8 μm.

Then, 6 parts of an anionic surfactant, sodium dodecylbenzenesulfonate (Neogen SC, produced by Daiichi Industries, Ltd.), was further added to the dispersion, and the mixture was heated to 97° C., kept at 97° C. for 7 hours to fuse the flocculated particles. Thereafter, the mixture was cooled to 45° C. at a decreasing temperature of 0.5° C./min., filtered, sufficiently washed with deionized water, and filtered through a 400-mesh screen. The volume average particle diameter of the fused particles, as determined with a Coulter counter, was 5.7 μm. These were dried in a vacuum dehydrator and toner particles were obtained. Sections of the toner particles were confirmed with a TEM unit, and the average domain diameter of the releasing agent was 1.1 μm.

1.5 parts of colloidal silica (R972, produced by Nippon Aerosil Co., Ltd.) were added to 100 parts of the resulting toner particles and mixed by a Henschel mixer to give toner C.

Preparation of Developer C

Toner C was weighed on a glass vessel so that the concentration of the toner relative to ferrite carriers having a volume average diameter of 50 μm and coated with 1% of polymethyl methacrylate (Soken Chemical & Engineering Co., Ltd.) was 5% by mass and was mixed with the ferrite carriers on a ball mill for 5 minutes, and whereby developer C was obtained.

Formation of an Image

The resultant developer C was set in a VIVACE 400 modified machine (fixing unit was composed of a heating roll and a belt; nip width was 8 mm), and a toner density per unit area was adjusted to 4.0 mg/cm$^2$ and a toner image was formed on paper (gloss 47), and then fixed at a fixing temperature of 170° C. at a process speed of 170 mm/sec., and the difference in gloss between the fixed image and the paper was confirmed. Further, storage under stress and evaluation of OHP transmission were carried out in the same manner as in Example 1. The results are shown in Table 1.

Comparative Example 1

| Preparation of toner D | |
|---|---|
| fine resin particle dispersion (1) | 300 parts |
| colorant particle dispersion (1) | 200 parts |
| releasing agent particle dispersion (1) (9.1% by mass relative to the toner) | 50 parts |
| cationic surfactant (Sanizol B50, Kao Corporation) | 3 parts |
| deionized water | 500 parts |

The above components were mixed and dispersed with a homogenizer (Ultratarax T50, produced by IKA Co., Ltd.) in a stainless steel flask having a round bottom, and then heated in an oil bath to 50° C. while stirred and then kept at 50° C. for 30 minutes to form flocculated particles. When a part of the resulting flocculated particles were observed under an optical microscope, the average diameter of the flocculated particles was about 5.2 μm. 30 parts of the fine resin particle dispersion (1) was added gently to this flocculated particle dispersion and the resultant mixture was heated at 50° C. for 30 minutes, and the resulting flocculated particle dispersion was observed under an optical microscope and the average diameter of the flocculated particles was about 5.9 μm.

Then, 6 parts of an anionic surfactant, sodium dodecylbenzenesulfonate (Neogen SC, produced by Daiichi Industries, Ltd.), was further added to the dispersion, and the mixture was heated to 97° C., kept at 97° C. for 7 hours to fuse the flocculated particles. Thereafter, the mixture was cooled to 45° C. at a decreasing temperature of 0.5° C./min., filtered, sufficiently washed with deionized water, and filtered through a 400-mesh screen. The volume average particle diameter of the fused particles, as determined with a Coulter counter, was 5.8 μm. These were dried in a vacuum dehydrator and toner particles were obtained. Sections of the toner particles were confirmed with a TEM unit, and the average domain diameter of the releasing agent was 0.4 μm.

1.5 parts of colloidal silica (R972, produced by Nippon Aerosil Co., Ltd.) were added to 100 parts of the resulting toner particles and mixed by a Henschel mixer to give toner D.

Preparation of Developer D

Toner D was weighed on a glass vessel so that the concentration of the toner relative to ferrite carriers having a volume average diameter of 50 μm and coated with 1% of polymethyl methacrylate (Soken Chemical & Engineering Co., Ltd.) was 5% by mass and was mixed with the ferrite carriers on a ball mill for 5 minutes, and whereby developer D was obtained.

Formation of an Image

Using the resulting developer D, an image was formed (fixed) in the same manner as in Example 1 and then evaluated. The results are shown in Table 1.

Comparative Example 2

Formation of an Image

The same developer A as in Example 1 was set in a VIVACE 400 modified machine (fixing unit was composed of a heating roll and a belt; nip width was 6 mm), and a toner density per unit area was adjusted to 4.0 mg/cm$^2$ and a toner image was formed on paper (gloss 47), and then fixed at a fixing temperature of 190° C. at a process speed of 200 mm/sec., and the difference in gloss between the fixed image and the paper was confirmed. Further, storage under stress and evaluation of OHP transmission were carried out in the same manner as in Example 1. The results are shown in Table 1.

Comparative Example 3

Preparation of Toner E 300 parts of the fine resin particle dispersion (1), 200 parts of the colorant particle dispersion (1), and 220 parts (30.6% by mass relative to the toner) of the releasing agent particle dispersion (1) were mixed with each other and kept at 97° C. for 7 hours in the same manner as in Example 1 to fuse flocculated particles. Thereafter, the mixture was rapidly cooled to 45° C. at a decreasing temperature of 2.0° C./min., filtered, sufficiently washed with deionized water, and filtered through a 400-mesh screen. The volume average particle diameter of the fused particles, as determined with a Coulter counter, was 5.7 $\mu$m. These were dried in a vacuum dehydrator and toner particles was obtained. Sections of the toner particles were confirmed with a TEM unit, and the average domain diameter of the releasing agent was 2.0 $\mu$m.

1.5 parts of colloidal silica (R972, produced by Nippon Aerosil Co., Ltd.) were added to 100 parts of the resulting toner particles and mixed by a Henschel mixer to give toner E.

Preparation of Developer E

Toner E was weighed on a glass vessel so that the concentration of the toner relative to ferrite carriers having a volume average diameter of 50 $\mu$m and coated with 1% of polymethyl methacrylate (Soken Chemical & Engineering Co., Ltd.) was 5% by mass and was mixed with the ferrite carriers on a ball mill for 5 minutes, and whereby developer E was obtained.

Formation of an Image

Using the resulting developer E, an image was formed (fixed) in the same manner as in Example 1 and then evaluated. The results are shown in Table 1.

From the results in Table 1, it can be seen that even if a highly glossy paper is used, an image excellent in storage ability with gloss equal to or higher than the gloss of the paper can be obtained at high speed in the method of forming images with a toner suitably containing a releasing agent wherein fixation is carried out so as to satisfy the specific relationship between fixing temperature and heating time.

What is claimed is:

1. A method of forming images, the method comprising:

forming electrostatic latent images on an electrostatic image carrier;

forming toner images with a toner-containing developer by developing the electrostatic latent images on the electrostatic image carrier;

transferring the toner images onto transfer materials; and thermally fixing the toner images in at least two stages, wherein the toner is an electrophotographic toner comprising at least a binder resin, a colorant, and a releasing agent in the range of 10 to 25% by mass relative to the toner and having a shape factor SF-1 of 140 or less, and the thermal fixing step is carried out so as to satisfy, at a process speed of at least 170 mm/sec., the relationship (A): $200<0.7\times\alpha+2000\times\beta$, when all stages are combined, wherein $\alpha$ is a fixing temperature (° C.), $\beta$ is a heating time (second), and $\alpha$ is 160° C. or higher, and wherein $0.7\times\alpha+2000\times\beta$ in the first stage is higher than $0.7\times\alpha+2000\times\beta$ in a stage other than the first stage.

2. A method of forming images according to claim 1, wherein an average domain diameter of the releasing agent is 0.5 to 2.3 $\mu$m.

3. A method of forming images according to claim 2, wherein the electrophotographic toner is obtained by a wet process comprising forming flocculated particles in a dispersion having at least fine resin particles, colorant particles, and releasing agent particles dispersed therein, and heating the dispersion of flocculated particles to fuse the flocculated particles.

4. A method of forming images according to claim 3, wherein the wet process further comprises cooling the fused flocculated particles after the heating step, and wherein the average domain diameter of the releasing agent is regulated in the cooling step.

5. A method of forming images according to claim 3, wherein the wet process further comprises allowing fine particles to adhere to the flocculated particles between the flocculating step and the heating step.

6. A method of forming images according to claim 1, wherein the electrophotographic toner is obtained by a wet

TABLE 1

| | Toner composition | | Fixing conditions | | | | | Evaluation | | |
|---|---|---|---|---|---|---|---|---|---|---|
| | Amount of the releasing agent (mass %) | Average domain diameter releasing agent ($\mu$m) | Fixing temperature (°C.) | Nip width (mm) | Process speed (mm/sec) | Heating time ($\times10^{-2}$ sec) | Value of right side in formula (A) | Gloss | Storage under stress | OHP transmission (75% or more PE: ○) |
| Example 1 | 18.0 | 1.4 | 180 | 7 | 180 | 3.9 | 204 | 48.3 ○ | ○ | ○ |
| Example 2 | 21.9 | 1.8 | 180 | 5.5 × 2 | 200 | 5.5 in total | 236 | 53.2 ○ | ○ | ○ |
| Example 3 | 19.4 | 1.1 | 170 | 8 | 170 | 4.7 | 213 | 45.1 ○ | ○ | ○ |
| Comparative Example 1 | 9.1 | 0.4 | 180 | 7 | 180 | 3.9 | 204 | 40.7 X | X | X |
| Comparative Example 2 | 18.0 | 1.4 | 190 | 6 | 200 | 3.0 | 193 | 31.3 X | X | X |
| Comparative Example 3 | 30.6 | 2.0 | 180 | 7 | 180 | 3.9 | 204 | 47.3 ○ | ○ | X |

process comprising forming flocculated particles in a dispersion having at least fine resin particles, colorant particles, and releasing agent particles dispersed therein, and heating the dispersion of flocculated particles to fuse the flocculated particles.

7. A method of forming images according to claim 6, wherein the wet process further comprises cooling the fused flocculated particles after the heating step, and wherein the average domain diameter of the releasing agent is regulated in the cooling step.

8. A method of forming images according to claim 6, wherein the wet process further comprises allowing fine particles to adhere to the flocculated particles between the flocculating step and the heating step.

9. A method of forming images according to claim 1, wherein the thermal fixing step is carried out so as to satisfy the relationship (A'): $220<0.7\times\alpha+2000\times\beta$, when all stages are combined, wherein $\alpha$ is the fixing temperature (° C.), $\beta$ is the heating time (second), and $\alpha$ is 160° C. or higher.

10. A method of forming images according to claim 1, wherein the releasing agent in the toner is 15 to 25% by mass.

11. A method of forming images according to claim 1, wherein the releasing agent in the toner is 17 to 20% by mass.

12. A method of forming images according to claim 1, wherein an average domain diameter of the releasing agent is 0.8 to 1.6 $\mu$m.

13. A method of forming images according to claim 1, wherein the shape factor SF-1 of the toner is 137 or less.

14. A method of forming images according to claim 1, wherein the shape factor SF-1 of the toner is 135 or less.

15. A method of forming images according to claim 1, wherein a volume average particle diameter of the toner is 3 to 8 $\mu$m.

16. A method of forming images according to claim 1, wherein the temperature in the thermal fixing step is 160 to 200° C.

17. A method of forming images according to claim 1, wherein the developer comprises a carrier.

* * * * *